US006264117B1

(12) United States Patent
Roman

(10) Patent No.: US 6,264,117 B1
(45) Date of Patent: Jul. 24, 2001

(54) SPRAY NOZZLE FOR POP-UP UNDERGROUND SPRINKLER

(75) Inventor: Gianfranco Roman, Pasiano (IT)

(73) Assignee: Claber S.p.A. (IT)

( * ) Notice: Subject to any disclaimer, the term of this patent is extended or adjusted under 35 U.S.C. 154(b) by 0 days.

(21) Appl. No.: 09/541,293

(22) Filed: Apr. 3, 2000

(30) Foreign Application Priority Data

Apr. 7, 1999 (IT) ..... MI99A0710

(51) Int. Cl.[7] ..... B05B 15/10; B05B 1/32

(52) U.S. Cl. ..... 239/203; 239/201; 239/456; 239/451; 239/539; 239/DIG. 1; 239/457

(58) Field of Search ..... 239/200, 201, 239/203–206, 451, 456, 457, 460, 498, 539, DIG. 1

(56) References Cited

U.S. PATENT DOCUMENTS

| | | | | |
|---|---|---|---|---|
| 5,148,990 | * | 9/1992 | Kah, Jr. | 239/457 X |
| 5,205,491 | * | 4/1993 | Hadar | 239/457 |
| 5,226,602 | | 7/1993 | Cochran et al. | 239/583 |
| 5,322,223 | * | 6/1994 | Hadar | 239/457 |
| 5,360,167 | * | 11/1994 | Grundy et al. | 239/460 |
| 5,556,036 | | 9/1996 | Chase | 239/457 |
| 5,642,861 | * | 7/1997 | Ogi et al. | 239/DIG. 1 |
| 6,019,295 | * | 2/2000 | McKenzie | 239/451 |
| 6,145,758 | * | 11/2000 | Ogi et al. | 239/457 |

FOREIGN PATENT DOCUMENTS

| | | |
|---|---|---|
| 0 860 190 | 8/1996 | (EP) . |
| 0 761 312 | 3/1997 | (EP) . |

* cited by examiner

*Primary Examiner*—Lesley D. Morris
(74) *Attorney, Agent, or Firm*—Akerman Senterfitt

(57) ABSTRACT

A spray nozzle for pop-up underground sprinkler comprises a main fixed body and a revolving ring nut that is associated with the aforesaid main body in order to allow the adjustment of the spray angle. The main body and the ring nut as a whole create an area for the containment of water that communicates with the outside through an adjustable scroll-shaped radial passage. The ring nut in addition forms in communication with the aforementioned area an accumulation chamber in which the water flow is subject to compression for the formation of a uniform output spray.

3 Claims, 4 Drawing Sheets

SPRAY NOZZLE FOR POP-UP UNDERGROUND SPRINKLER

DESCRIPTION

The present invention concerns a spray nozzle for pop-up underground sprinkler.

As known, underground sprinklers or pop-up sprinklers deliver water at a nozzle fixed to the mobile part of the sprinkler and therefore subject to the characteristic up and down movement of sprinklers of that type.

A form of nozzle currently in use provides for a fixed main body that is suitable to receive the water flow coming from the sprinkler and to deliver it toward the outside under form of pre-established rate spray and a revolving ring nut associated with the aforesaid main body in order to allow the adjustment of the spray angle. The main body is made up of an annular lower portion that is fixable to the upper end of the mobile part of the sprinkler and communicates with the orifice for the output of the same, an intermediate cross wall provided with a distribution of holes for the flow of water, an upper annular portion, a hub portion placed coaxially inside said upper annular portion and axially bearing a screw for adjusting the length of the spray, and a covering cap that is fixed over said hub portion. The revolving ring nut is in turn made up of a annular wall that is arranged around and threadedly engaged with said upper annular portion of the main body and of an upper cross wall that surrounds said hub portion while leaving around it an annular passage for the outflow of water from the area defined between said hub portion and said upper annular portion of the main body and it is in addition interposed between the top of said annular upper portion and said covering cap of the main body in order to define with the latter an adjustable radial flow shaped as a scroll for the formation and the outflow of a spray of water having adjustable angle.

In view of this state of the art the present invention aims at realising a spray nozzle for underground sprinklers of the pop-up type that has some advantageous aspects as regards the ones currently known of the aforesaid type. According to the invention a nozzle is provided that in first place is characterized in that the upper cross wall of the revolving ring nut has a bottom cavity shaped as a scroll that defines an accumulation chamber in which the flow of water in the area comprised between the hub portion and the upper annular portion of the main body is subject to compression for the formation of a uniform output spray at said adjustable radial passage.

In this way the annoying formation of lobes in the output spray of the nozzle is prevented.

According to another characteristic of the present invention it is further provided that the lower surface of the covering cap of the nozzle has a short discontinuity in radial direction that allows to break and to deviate a part of the spray in order to have the water reach also areas near the sprinkler.

These and other characteristics of the present invention will be made evident by the following detailed description of an embodiment thereof that is illustrated as a non limiting example in the enclosed drawings, in which.

Figure 1:
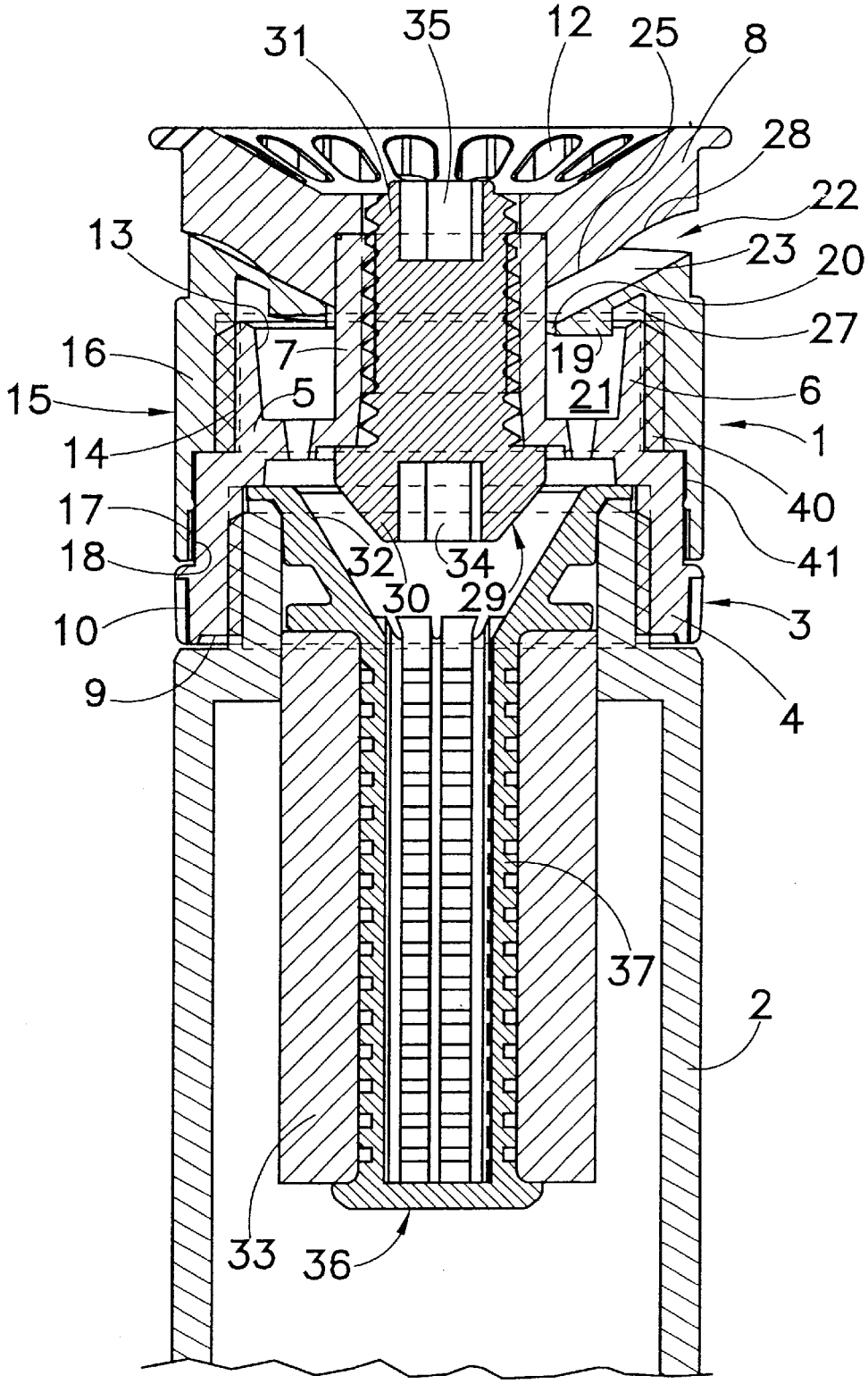
FIG. 1 shows in axial section the upper terminal part of a pop-up sprinkler that uses a spray nozzle according to the present invention.

With reference to FIG. 1, a spray nozzle 1 is shown as fixed to the upper end of the mobile part 2 of a pop-up underground sprinkler.

The nozzle 1 comprises a main body 3 that is made up of a lower annular portion 4, an intermediate cross wall 5, an upper annular portion 6, a hub portion 7 and a covering cap 8.

Figure 4:
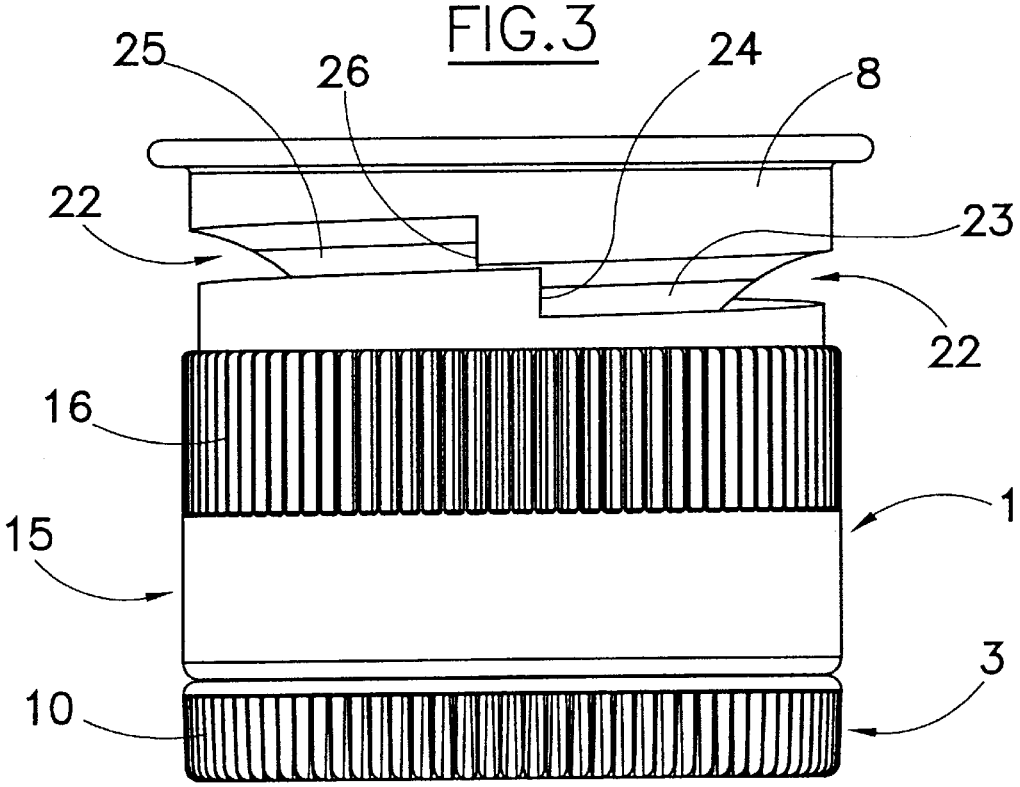
FIG. 4 shows the nozzle in side view.

The lower annular portion 4 is destined to fixing to the mobile part of the sprinkler and to such purpose it is provided with notches 9 on the bottom that are suitable to cooperate with appropriate teeth of the aforesaid mobile part (not shown in the drawing) in order to prevent the rotation of the head during the steps of positioning of the sprinkler and of adjustment of the spray. The aforesaid lower annular portion 4 is in addition provided with an annular knurling 10 (FIGS. 2 and 4).

The intermediate cross wall 5 is traversed by a circumferential distribution of conic holes 11 for the flow of the water coming from the sprinkler.

Figure 2:
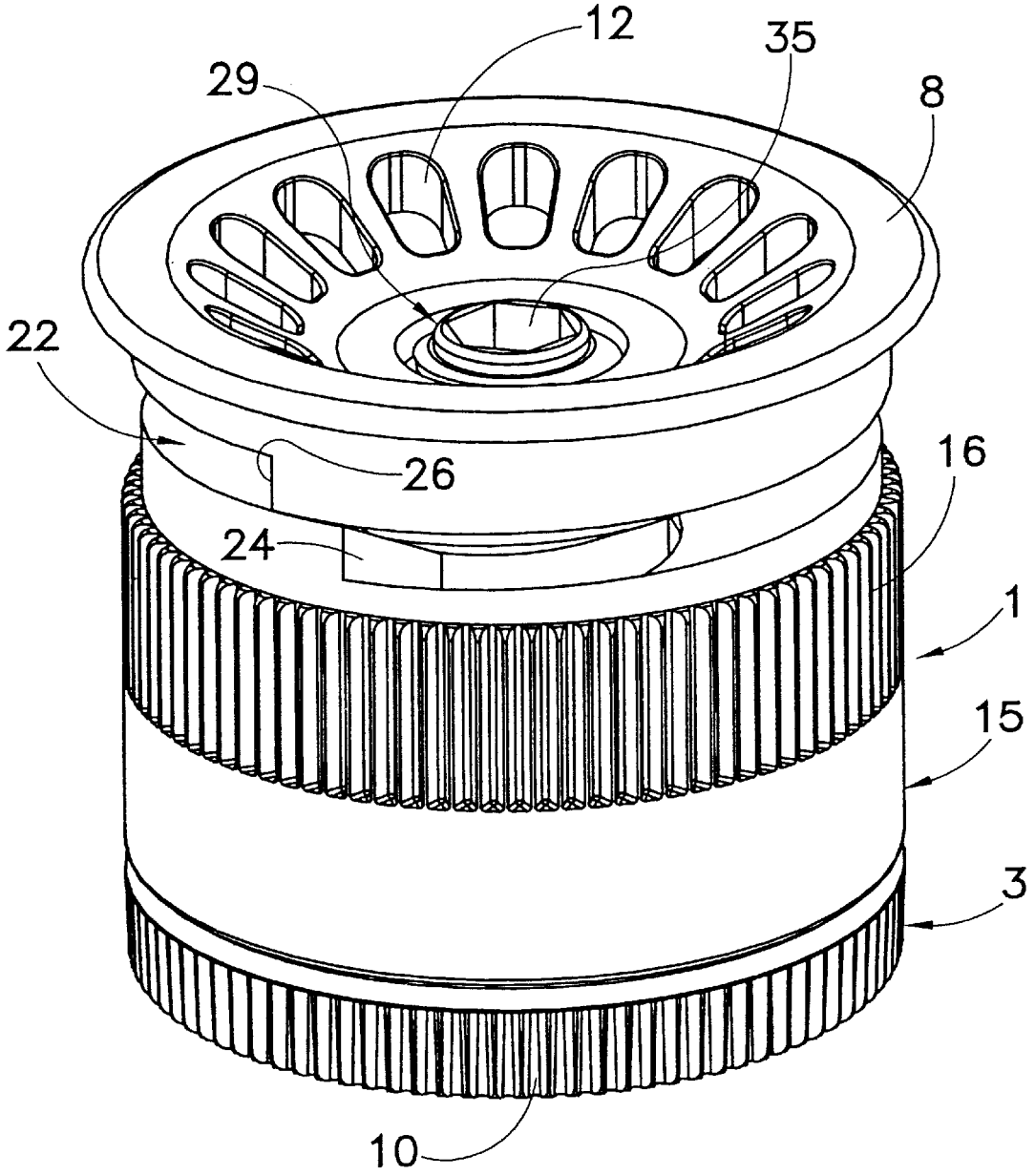
FIG. 2 shows the nozzle in perspective view from the top.
Figure 3:
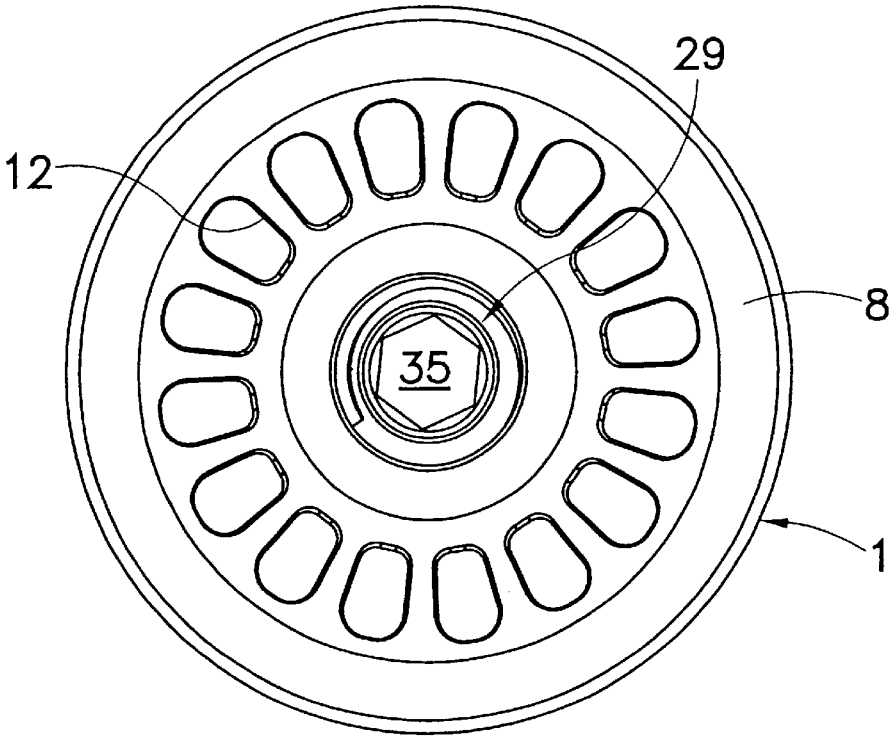
FIG. 3 shows the nozzle in top plan as regards FIG. 1.

The hub portion 7 extends axially toward the top from the intermediate cross wall 5 and bears the covering cap 8 on the top, that in turn has a shape flared toward the top and is provided with lightening holes 12 (FIGS. 1–3).

The upper annular portion 6 has an inside surface 13 flared toward the top and an external cylindrical surface 14 with which there is turningly engaged through a short-pitch (e.g. 1.5 mm) thread 40 an externally knurled annular wall 16 of an adjustment ring nut 15 that has on the bottom a hydraulic sealing ring 41 and an annular sequence of inside teeth 17 that engage with corresponding external teeth 18 of the lower annular portion 4 in order to keep the ring nut 15 in the desired angular position.

In addition, the ring nut 15 is provided with an upper cross wall 19 that surrounds the hub portion 7 (FIG. 1) thus leaving around it an annular passage 20 for the outflow of the water from the containment area 21 defined between the hub portion 7 and the upper annular portion 6 of the main body 3. The aforesaid upper cross wall 19 of the ring nut 15 is in addition interposed between the top of the upper annular portion 6 of the main body 3 and the covering cap 8, in order to define with the latter an adjustable radial passage 22 that is shaped as a scroll for the formation and the outflow of a spray of water with adjustable angle.

Figure 6:
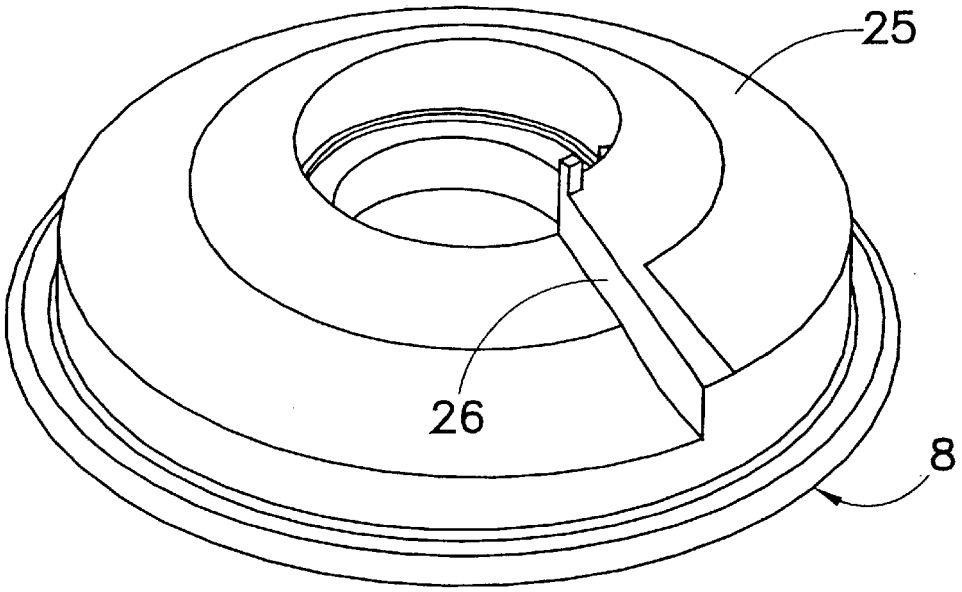
FIG. 6 shows the covering cap of the nozzle in perspective view from the bottom part.
Figure 5:
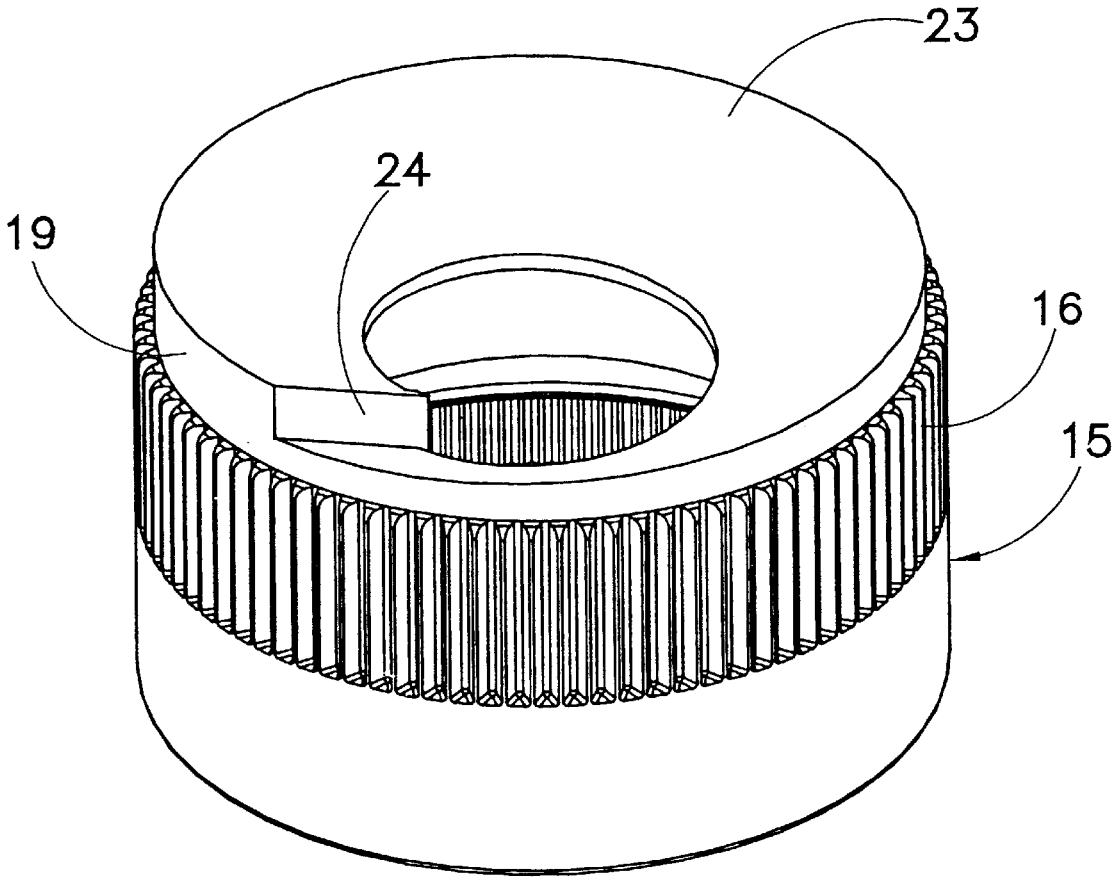
FIG. 5 shows the revolving ring nut of the nozzle in perspective view from the top.

The conformation of the scroll passage 22, that has the same pitch as the thread 40, is made understandable by FIGS. 5 and 6, that respectively show the scroll conformation of the upper surface 23 of the upper cross wall 19 of the ring nut 15 starting from an abutment front 24 and the one of the lower surface 25 of the covering cap 8 starting from an abutment front 26.

As is possible to observe from FIG. 1, the upper cross wall 19 of the ring nut 15 has a cavity 27 on the bottom shaped as a scroll that functions as a chamber for the accumulation and uniformation of the spray for the water that is contained in the above mentioned area 21.

From FIG. 1 it is also possible to remark that the lower surface 25 of the covering cap 8 has a short discontinuity 28 in radial direction, that has the task to cause a limited variation of the spray for the purposes that will be explained hereinafter.

Finally the nozzle 1 provides for a screw 29 for the adjustment of the length of the spray, that is made up of a head 30 and of a threaded shank 31, both of metal, preferably of stainless steel.

The head 30 of the screw 29 is positioned inside the nozzle 1 and in such a way so as to extend in the output cone 32 of the filter 36 of the sprinkler, which is made, as an example, by a rigid grid-like internal part 37 and by an external part 33 in reticular spongy material (for example of the type disclosed in EP-A-0860190), and is provided with a central cavity 34 with hexagonal section, that is suitable to receive a setscrew wrench for the fixing of the screw 29 inside the hub portion 7 of the nozzle 1.

The threaded shank 31 of the same screw instead projects outside of the covering cap 8 of the nozzle 1 and has a hexagonal cavity 35 that is in turn accessible from the outside (FIGS. 1–3), that is axially lined up with the cavity 34. The cavity 35 is suitable to receive a setscrew wrench for the adjustment of the axial position of the screw 29 as regards the output cone of the filter of the sprinkler and the consequent adjustment of the length of the output water spray.

The two cavities 34 and 35 have identical shape and identical dimensions, so that they can receive an identical setscrew wrench.

During operation, the flow of water coming from the sprinkler flows through the conic holes 11 of the intermediate cross wall 5 of the nozzle 1, it enters the area 21 defined above the same wall and finally goes out through the annular passage 20 and the passage shaped as a scroll 22 thus forming a spray that is made uniform by the compression action exerted by the accumulation chamber 27. The presence of the radial discontinuity 28 in the lower surface of the covering cap 8 allows to deviate part of the water spray in such a way so as to allow it to water even zones very near to the sprinkler.

The spray angle is adjustable by rotation of the ring nut 15, that by modifying the mutual position of the facing scroll-shaped surface of the ring nut 15 and of the covering cap 8 modifies the configuration of the output passage of the spray correspondingly and therefore the angle of the same.

The length of the spray is instead adjustable by modifying the axial position of the adjusting screw 29 through the adjustment cavity 35.

What is claimed is:

1. Spray nozzle for pop-up underground sprinkler comprising a main fixed body suitable to receive the water flow coming from the sprinkler and to deliver it toward the outside under form of pre-established rate spray and a revolving ring nut associated with the aforesaid main body in order to allow the adjustment of the spray angle, said main body being made up of an annular lower portion that is fixable to the upper end of the mobile part of the sprinkler and communicates with the orifice of output of the same, an intermediate cross wall provided with a distribution of holes for the flow of the water, an upper annular portion, a hub portion placed coaxially inside said upper annular portion and a covering cap fixed over said hub portion, said ring nut being in turn made up of an annular wall that is turningly engaged with said upper annular portion of the main body and of an upper cross wall that surrounds said hub portion thus leaving around it an annular passage for the outflow of water from the area defined between said hub portion and said upper annular portion of the main body and is further interposed between the top of said annular upper portion and said covering cap of the main body in order to define with the latter an adjustable radial passage shaped as a scroll for the formation and the outflow of a spray of water with adjustable angle, characterised in that the upper cross wall of the revolving ring nut has a bottom cavity shaped as a scroll that defines an accumulation chamber in which the flow of water in the area comprised between the hub portion and the upper annular portion of the main body is subject to compression for the formation of a uniform output spray at said adjustable radial passage.

2. Spray nozzle according to claim 1, characterized in that the lower surface of the covering cap has a short discontinuity in radial direction that allows to break and to deviate a part of the spray in order to have the water reach also areas near the sprinkler.

3. Spray nozzle according to claim 1, characterized in that it comprises a screw for the adjustment of the length of the spray, said screw comprising a head extending in the output orifice of the sprinkler and a threaded shank that is screwed into the hub portion of the main body of the nozzle, said head and said shank provided with identical cavities for setscrew wrench that are engageable with the same operating tool for the fixing and, respectively, the adjustment of the screw.

* * * * *